United States Patent [19]

Blessing

[11] 4,292,908

[45] Oct. 6, 1981

[54] HEMMER-SEAMER

[75] Inventor: Hubert Blessing, Dallas, Tex.

[73] Assignee: Levi Strauss & Co., San Francisco, Calif.

[21] Appl. No.: 947,598

[22] Filed: Oct. 2, 1978

[51] Int. Cl.[3] ..... D05B 33/00; D05B 35/10; D05B 21/00

[52] U.S. Cl. ..... 112/306; 112/121.12; 112/141; 112/153; 112/3.2

[58] Field of Search ..... 112/312, 313, 314, 318, 112/319, 320, 141, 121.11, 121.15, 121.12, 153, 152, 136, 121.26, 148, 304, 305, 306; 242/57.1; 226/17, 20; 271/251

[56] References Cited

U.S. PATENT DOCUMENTS

| | | | |
|---|---|---|---|
| 3,713,408 | 1/1973 | Deeks et al. | 112/112.15 |
| 3,761,073 | 9/1973 | Brain | 112/121.15 X |
| 3,799,084 | 3/1974 | Furnari | 112/319 |
| 3,903,818 | 9/1975 | Marforio | 112/121.15 |
| 3,970,015 | 7/1976 | Fukuyama | 112/153 X |
| 3,986,467 | 10/1976 | Hornkohl | 112/153 X |
| 4,013,025 | 3/1977 | Marforio | 112/121.15 |
| 4,044,698 | 8/1977 | Conner, Jr. | 112/153 X |
| 4,062,309 | 12/1977 | Pollmeier et al. | 112/121.26 X |
| 4,074,640 | 2/1978 | Chano et al. | 112/121.11 |
| 4,098,201 | 7/1978 | Adamski, Jr. et al. | 112/141 X |
| 4,111,138 | 9/1978 | Rockerath et al. | 112/141 |
| 4,132,184 | 1/1979 | Burton | 112/121.26 X |

*Primary Examiner*—Werner H. Schroeder
*Assistant Examiner*—Andrew M. Falik
*Attorney, Agent, or Firm*—Philip M. Shaw, Jr.

[57] ABSTRACT

Apparatus for independently guiding two overlaid fabric workpieces as they are simultaneously fed through a sewing work station and are seamed together, wherein the guide apparatus comprises a pair of opposed guide wheels located upstream from the work station with respect to the direction of workpiece feed through the work station; separate servo motors for rotating guide wheels in planes perpendicular to the direction of workpiece feed; a separating bar for spacing apart the two workpieces and for individually pressing them against a different one of the guide wheels; and separate sensors for monitoring the edges of each workpiece and for controlling the servo motors separately to rotate their guide wheels so as to center each workpiece edge opposite its corresponding sensor.

7 Claims, 14 Drawing Figures

HEMMER-SEAMER

BACKGROUND OF THE INVENTION

1. Field of the Invention

This invention relates to a fabric workpiece seamer, more particularly to apparatus for automatically guiding the workpieces as they are seamed.

2. Prior Art

Nearly every type of garment, other than those which are molded or knitted, requires seams. Seaming is a rather complicated task and only highly skilled operators, after prolonged training, are used for such operations. It is of utmost importance that the front and rear ends of the pieces seamed together be in alignment; that the seam be uniform in width, tension and neatness; and that it be straight or, alternatively, that it follow a predetermined curve. There is also the ever-occurring problem of puckering. Several devices have been proposed for controlling the rate of feed of the two workpieces in order that the ends come out evenly at the end of the seam. See, for examples, U.S. Pat. Nos. 3,903,818 (Marforio) and 3,954,071 (Mall, et al.). Heretofore, prior art devices such as Marforio's and Mall's have only been capable of sewing straight seams. Unfortunately, most garments must be sewn with three-dimensional shapes and this often means that the two workpieces, when overlaid, do not have the same edge contours. Thus, the workpieces must be independently manipulated as they are sewn together while at the same time providing equal tension on both workpieces to prevent puckering and to ensure that the ends will come out at the same point.

SUMMARY OF THE INVENTION

The above disadvantages of prior art automatic seamers are overcome by the present invention of apparatus for independently guiding the two overlaid workpieces as they are seamed together, the apparatus comprising a pair of opposed guide wheels located upstream from the work station with respect to the direction of workpiece feed through the work station. The guide wheels are rotated in planes perpendicular to the direction of the workpiece feed by separate servo motors under the control of separate workpiece sensors. The workpieces are separated from each other by a cantilevered blade which presses a portion of each workpiece against a different guide wheel. Each sensor is mounted adjacent the edge of each workpiece for detecting the workpiece outline and for controlling the servo motor whose associated guide wheel is in contact with the workpiece. Under the control of the sensor, the servo motor moves its guide wheel, and hence the workpiece, to center the workpiece edge opposite the guide wheel's servo motor control sensor. In this way, the workpieces are manipulated so that as their edges pass by the sensors, they are in constant alignment with the sensors and each other.

In the preferred embodiment, a gripper is provided for grasping together the trailing ends of both workpieces. The gripper is mounted on a rod so that it can slide in the direction of the workpiece feed. Means are connected to the gripper for applying a constant retarding force on the gripper which is opposite in direction to that of the workpiece feed, so that a constant tension is applied to the workpiece trailing ends to prevent puckering. A belt transport downstream from the guiding wheels receives the positioned workpieces and clasps them together. The belt transport then carries the clasped-together, aligned workpieces through the sewing machine where they are seamed.

Manual loading means are provided for initially gripping together the leading edges of the workpieces and gripping together the trailing edges of the workpieces. Thereafter, these gripped-together leading edges are automatically inserted into the belt transport means and the gripped-together trailing edges are automatically inserted into the trailing edge gripper to commence the seaming operation.

Thus, with the apparatus of the present invention, a pair of workpieces can be automatically sewn together with their edges aligned even though their edges have dissimilar contours when overlaid prior to the sewing operation. Furthermore, because of the constant tension placed on the workpieces as they are sewn, no puckering takes place.

It is therefore an object of the present invention to provide apparatus for automatically seaming together two workpieces having dissimilar contours so that the seamed edges are aligned.

It is another object of the invention to provide apparatus for automatically sewing together two workpieces with a pucker-free seam.

It is still another object of the invention to provide automatically loadable apparatus for seaming two workpieces together.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
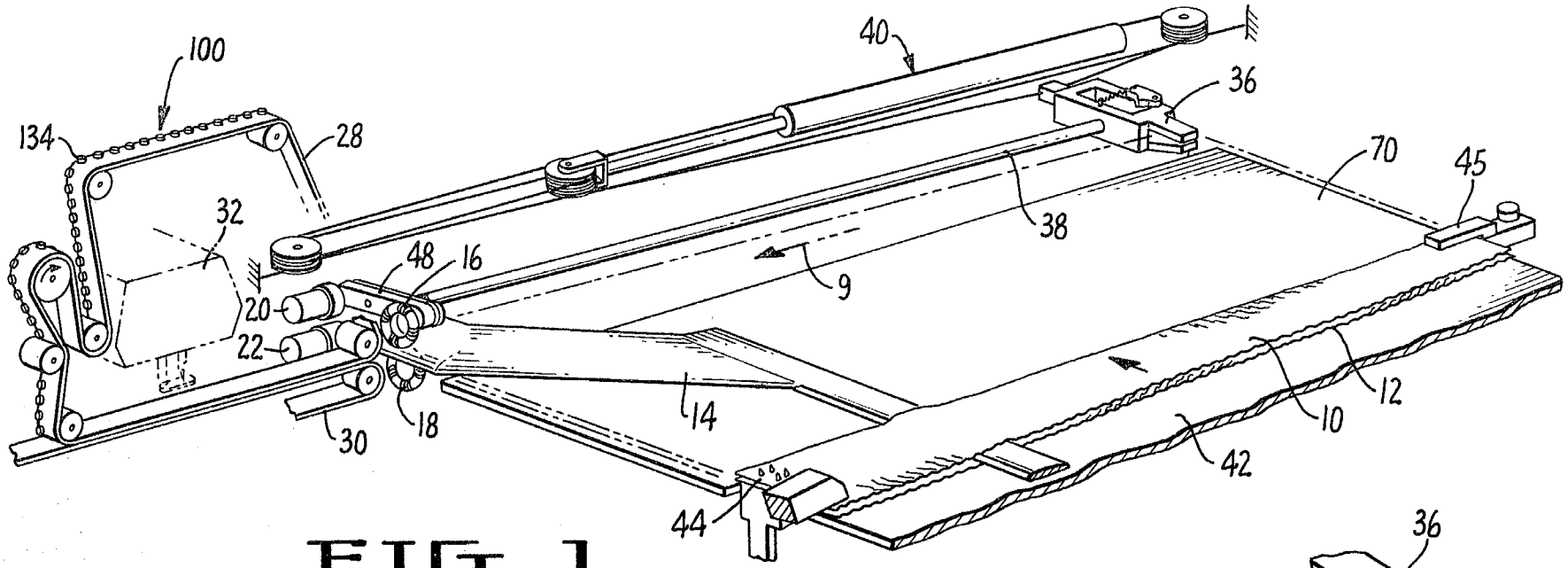
FIG. 1 is a perspective view of the seamer, according to the invention, with portions broken away.

Referring now more particularly to FIG. 1, the purpose of the apparatus of the invention is to seam together an upper workpiece 10 and a lower workpiece 12 along one edge in such a way that the seamed-together edges are aligned with each other. The workpieces 10 and 12 are separated by a cantilevered, horizontal spacing bar 14. An upper guide wheel 16 is positioned to press the workpiece 10 against a roller 54 mounted in the upper surface of the bar 14 adjacent the edge of the workpiece which is to be seamed. Similarly, a lower guide wheel 18 is positioned to press the lower workpiece 12 against a corresponding roller 54' in the lower surface of the bar 14 adjacent the edge of the workpiece to be seamed (see FIG. 11). The guide wheels 16 and 18 are positioned to rotate in planes which are perpendicular to the direction of workpiece feed indicated by arrow 9. The guide wheels 16 and 18 are separately rotated by servo motors 20 and 22, respectively. The upper servo motor 20 is operated under the control of an upper photo-optic sensor 24, and the lower servo motor 22 is operated under the control of a lower photo-optic sensor 26. The photo-optic sensors 24 and 26 shine light toward the reflective surface of the spacing bar 14, downstream from the guide wheel 16 with respect to the direction of fabric feed 9.

Figure 2:
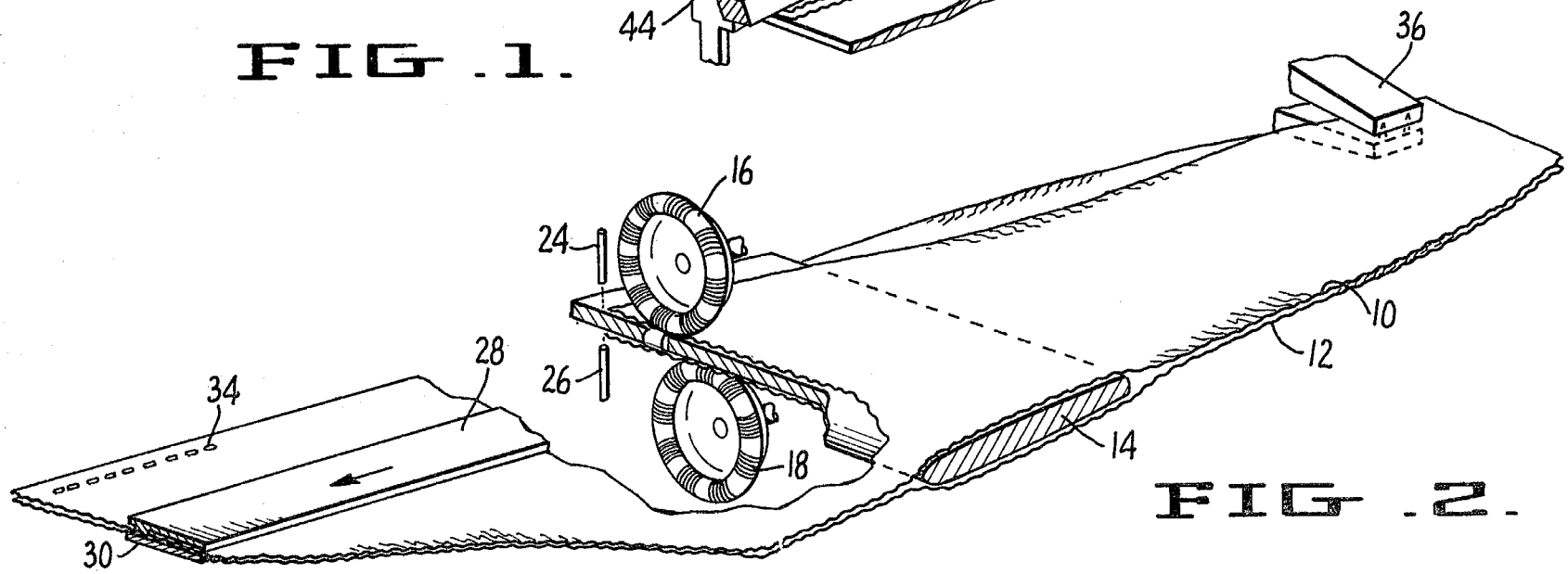
FIG. 2 is an enlarged, perspective view, partly in section and with portions broken away, of a portion of the seamer depicted in FIG. 1.
Figure 8:
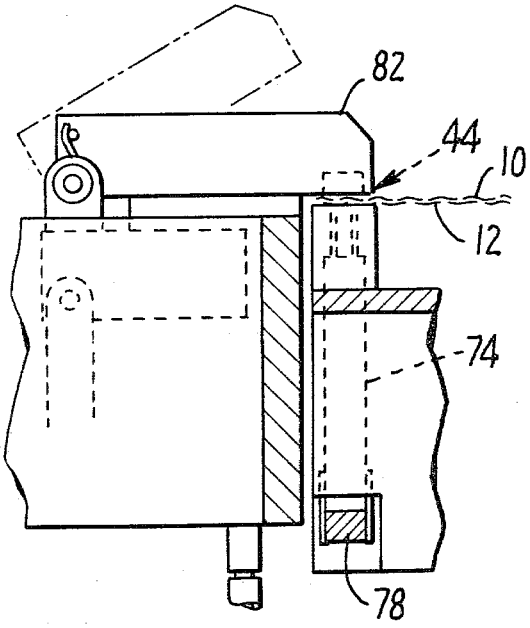
FIG. 8 is an enlarged, vertical, sectional view of the loader gripper cover mechanism, taken generally along the lines 8—8 in FIG. 7.

As best illustrated in FIGS. 2 and 8, the sensors 24 and 26 are positioned in an aligned fashion directly above the desired aligned position of the edges of the workpieces 10 and 12, prior to seaming. Each photosensor 24 or 26 detects when the workpiece edge beneath or above it is no longer centered with respect to the sensor; it then sends an electrical signal to cause the servo motor to which the sensor is connected to rotate the servo motor's guide wheel 16 or 18 in a direction which will recenter the fabric edge with respect to that sensor. The circuitry required to carry out this servo positioning operation is disclosed in U.S. Pat. No. 4,019,447, and is now well-understood by those skilled in the art. For this reason, the servo mechanism will not be described herein in greater detail. Similar circuitry is also disclosed in U.S. Pat. No. 3,650,229. Both of these patents are incorporated herein by reference.

As the edges of the workpieces 10 and 12 are continuously aligned with each other by guide wheels 16 and 18, the aligned portion of the workpieces 10 and 12 is gripped between an upper gripper belt 28 and a lower gripper belt 30 which are motor driven in the direction of fabric feed 9 past a sewing machine 32. As best shown in FIG. 2, the edges of the workpieces 10 and 12 extend beyond the edges of the belts 28 and 30 so that the sewing machine 32 can produce a seam 34 through both of the workpieces.

There is a natural tendency in sewing the workpieces 10 and 12 together for one workpiece to move through the sewing machine at a faster rate than the other. This can be caused by differences in the fabric texture as well as by slight discrepancies in the workpiece feed and advancing mechanisms. This differential feed rate can produce undesirable puckering in the seam. In order to prevent this, the trailing edges of the workpieces 10 and 12 are pinned together by a trailing edge gripper 36. The gripper 36 slides on a horizontal rod 38 which is parallel to the direction of the fabric feed 9 and extends to the guide wheels 16 and 18. A constant force is applied to the gripper 36 to oppose the direction of fabric feed and thus put the workpieces under a slight but constant tension. This force is applied to the gripper 36 by a constant tension assembly 40 whose details will be described further herein.

Referring again to FIG. 1, the overlaid workpieces 10 and 12 are initially loaded into the guiding and sewing assembly by manually placing the workpieces one on top of the other on a table 42 which slides sideways with respect to the direction of feed 9. The edges of the workpieces which are closest to the sewing assembly are first manually aligned; then the leading edges are automatically pinned together by means of mechanically projected pins 44 at the downstream end of the loading table 42; and the trailing ends are temporarily pinched together by a hand-operated gripper 45. As will later be described in greater detail, the operator presses a switch to cause the loading table 42 to slide sideways, carrying with it the overlaid workpieces 10 and 12. Once the leading edges of the workpieces are in place beneath the guide wheels 16 and 18 and the gripper belts 28 and 30, the pins 44 are automatically withdrawn while the trailing edges are simultaneously transferred to the trailing edge gripper 36. This cursory description is given in order to make it easier to understand the remainder of the description.

Figure 9:
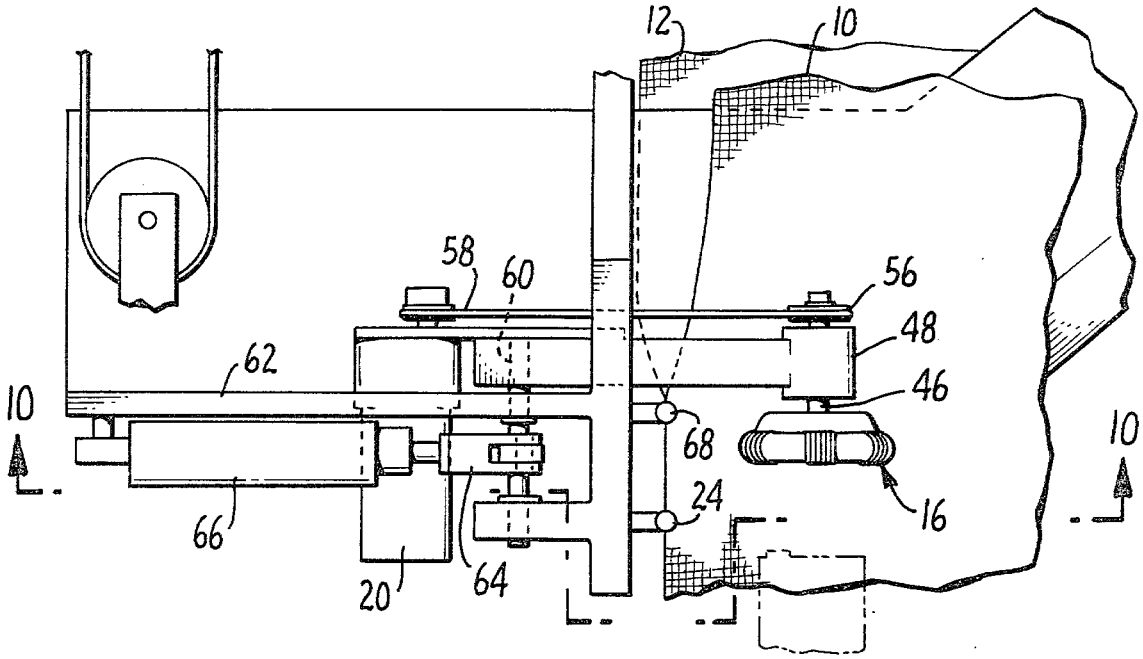
FIG. 9 is an enlarged, plan view, with portions broken away, of the workpiece guide wheels according to the invention.
Figure 10:
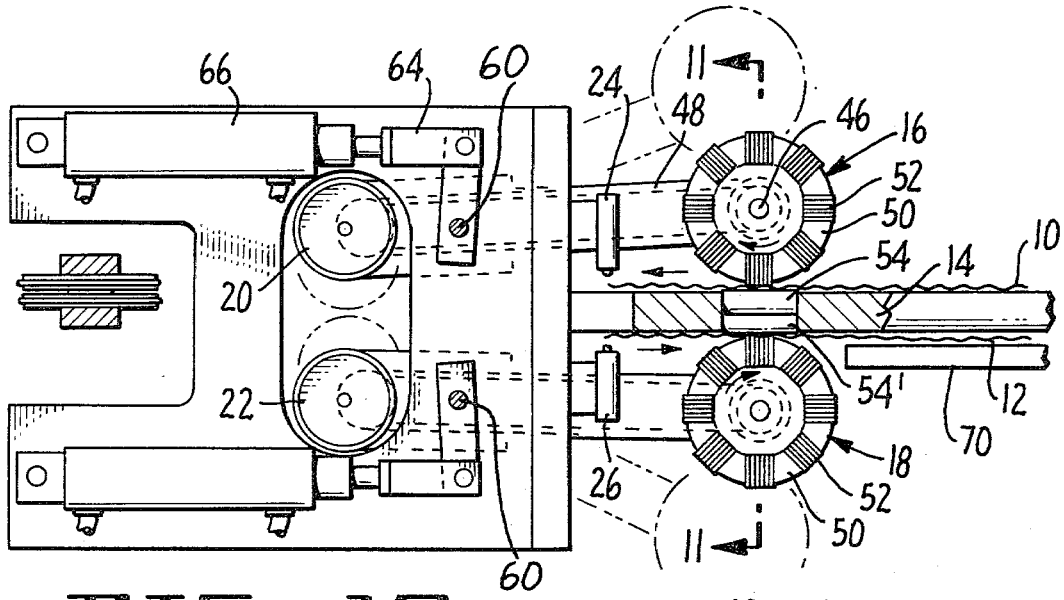
FIG. 10 is an enlarged, vertical sectional view, with portions broken away, taken generally along the lines 10—10 in FIG. 9.
Figure 11:
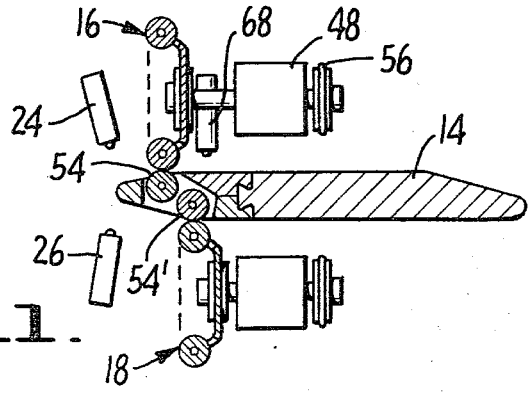
FIG. 11 is a vertical, sectional view, with portions broken away, taken generally along the lines 11—11 in FIG. 10.

Referring now more particularly to FIGS. 9, 10 and 11, the guide wheel assembly will be described in greater detail. The upper guide wheel 16 and the lower guide wheel 18 are mounted on assemblies which are substantially identical and therefore only the support assembly for the upper guide wheel 16 will be described. The guide wheel 16 rotates in a plane perpendicular to the direction of workpiece feed 9. The wheel 16 is mounted on a rotatable support shaft 46 carried in one end of a pivotable support arm 48. Each guide wheel 16 and 18 is comprised of a generally toroidal member 50 which carries a plurality of circumferentially spaced-apart, rotatable wheels 52. The wheels 52 are mounted on the toroid 50 in such a manner that they can rotate in the direction of fabric feed thereby reducing drag on the workpiece as it is pulled beneath the guide wheels by the belts 28 and 30. As best shown in FIGS. 10 and 11, the separating arm or bar 14 is provided with inset rollers 54 and 54' against which the wheels 52 press the workpieces 10 and 12 during the guiding operation. The rollers 54 and 54' also rotate in the direction of fabric feed in order to reduce drag.

The end of the shaft 46 opposite the guide wheels is provided with a pulley 56. A drive belt 58 connects the pulley 56 to the output shaft of the motor 20. The motor 20 is mounted on an extension of the guide wheel support arm 48 at the end opposite the shaft 46. The support arm 48 is mounted on a shaft 60 rotatably supported in an upstanding web 62 of the basic work station support structure. The shaft 60 can be rotated by means of a crank arm assembly 64 operated by a pneumatic or hydraulic actuator 66. As best shown in FIG. 10, when the actuator 66 retracts, the crank arm 64 causes the shaft 60 to be rotated counter-clockwise as viewed in FIG. 10. This raises the support arm 48 as shown in dashed-line fashion in FIG. 10.

During the loading operation, the guide wheels 16 and 18 are in the spaced-apart position to receive the workpieces 10 and 12 as they are loaded by means of the loading table 42. A photo-cell sensor 68 mounted between the sensor 24 and the support arm 48 on the extension of the web 62 detects the presence of the workpieces and triggers actuators 66 to lower the guide wheel 16 and raise the guide wheel 18 into engagement with the workpieces 10 and 12, respectively, in the manner described above.

The photo-optic sensors 24 and 26 control the guide wheel drive motors 20 and 22 so as to center the innermost edge of the workpieces 10 and 12 with respect to the sensors 24 and 26, respectively. Thus, in the positions shown in FIG. 10, the photo-optic sensor 24 detects that the workpiece 10 is not centered beneath it and causes the motor 20 to rotate the guide wheel 16 in a clockwise direction, as viewed in FIG. 10, until the edge of the workpiece 10 is centered beneath the photo-optic sensor 24. Conversely, the photo-optic sensor 26 detects that the workpiece 12 is fully positioned over the photo-optic sensor 26. The sensor 26 will cause the motor 22 to rotate the guide wheel 18 in a clockwise direction to slide the workpiece 12 outwardly with respect to the sensor 26 until the edge is centered directly over the sensor 26. It should be noted, at this point, that the workpieces 10 and 12 are supported after the loading table 42 is withdrawn by means of a planar support surface 70 which underlies the loading surface 42.

Referring now more particularly to FIGS. 1, 3, 5, 6, 7 and 8, the apparatus and procedure for loading the workpieces 10 and 12 into the hemmer according to the invention will be described. As mentioned above, the workpieces 10 and 12 initially are manually laid one on top of the other, on a horizontally slidable loading table 42. The table 42 is movable in a direction perpendicular to the direction of fabric feed 9 by means of a motorized carriage mechanism (not shown). The carriage for the table 42 is conventional and therefore will not be described. The trailing ends of the workpieces 10 and 12 are manually aligned and placed under a spring-mounted clip 72 which is part of the loading table trailing edge gripper assembly 45. The aligned, leading edges of the workpieces 10 and 12 are also manually placed over the retracted needles 44 at the opposite edge of the loading table 42.

Figure 7:
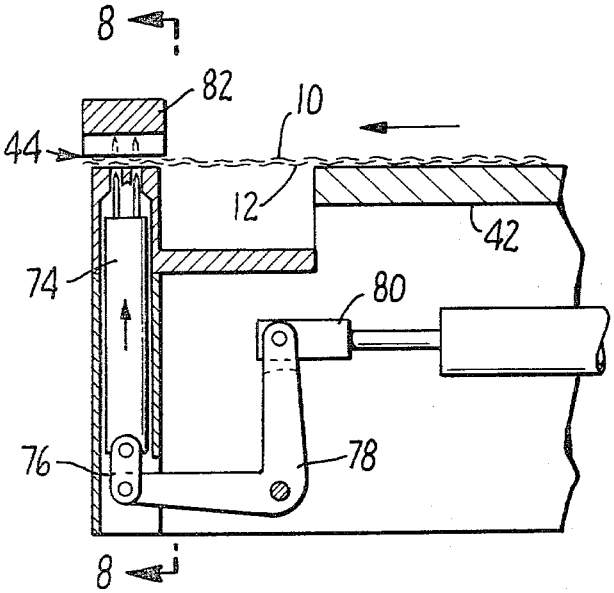
FIG. 7 is an enlarged, vertical, sectional view of the leading edge, loader gripper, taken generally along the lines 7—7 in FIG. 3.

As best viewed in FIGS. 7 and 8, the needles 44 are mounted on a shaft 74 slidable in a sleeve 76 which is part of the loading table 42. The bottom of the shaft 74 is attached by means of a pivoted lift crank 78 to an actuator arm 80. It will be appreciated that when the actuator arm 80 is retracted, the crank will cause the shaft 74 to be lifted upwardly and to project the needles 44 beyond the top surface of the table 42. In order to prevent the workpieces 10 and 12 from being merely raised by the needles rather than punctured, a cover 82 is automatically lowered by an actuator (not shown) over the top of the workpieces 10 and 12 to hold them against the force of the projecting needles 44 so that the needles puncture through the fabric workpieces. The actuator thereafter opens the cover 82 and retracts it to the hidden line position shown in FIG. 8. The operator thereafter presses a switch (not shown) which causes the loader table 42 to carry the fabric workpieces, which are gripped together at their trailing ends by the gripper mechanism 45 and impaled together on the needles 44 at their leading ends, to the guide wheels 16 and 18 and the gripper belts 28 and 30. As mentioned above, the loader table 42 can be manually moved or it can be operated by a coventional motor and cable arrangement. The use of the perpendicular (to the sew line) transfer or loader table 42 allows the operator to load the machine while another garment is in the process of being sewn. Thus a series of panel pairs 10 and 12 can be sewn nonstop with the only time gap between the successive pairs being the time necessary for the motion of the loader table 42; representing a gap of about 6′ (15.24 cm.) between the panel pairs as they leave the sewing machine 32. The means by which the fabric workpieces 10 and 12 are automatically released from the table 42 to the sewing and guide wheel assembly will now be described.

Figure 6:
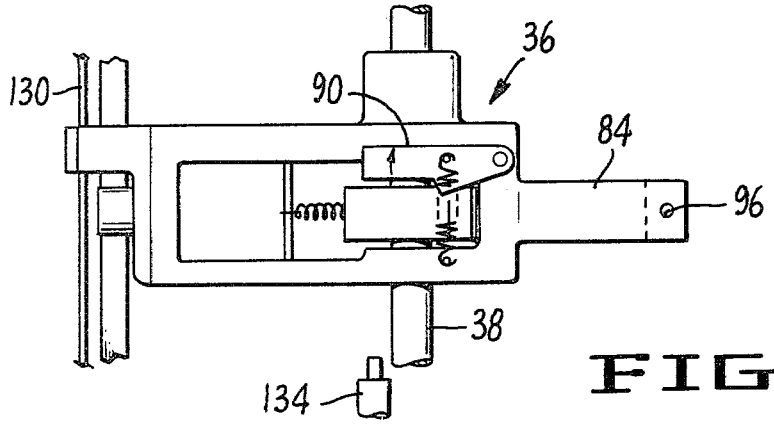
FIG. 6 is an enlarged, plan view of the trailing end gripper depicted in FIG. 5, with portions broken away.
Figure 5:
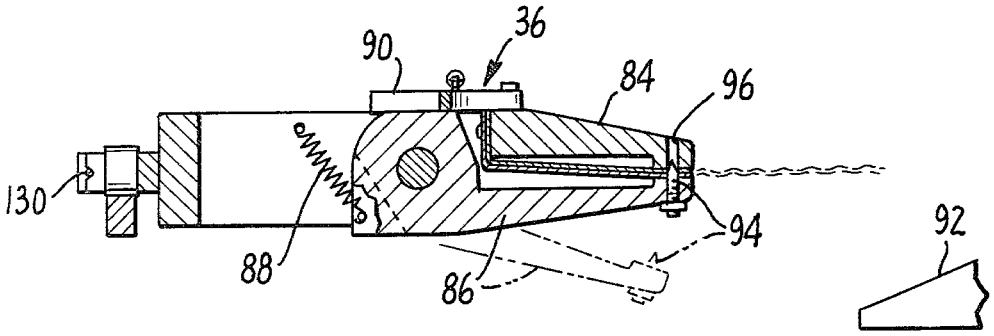
FIG. 5 is an enlarged, vertical, sectional view taken generally along the lines 5—5 in FIG. 3.

The release or transfer of the trailing edges is accomplished simply by automatically gripping the trailing edges between a pair of jaws on the movable trailing edge gripper assembly 36 while releasing the trailing edges from the gripper 72. Referring more particularly to FIGS. 5 and 6, the trailing edge gripper assembly 36 is comprised of a stationary upper jaw member 84 and a lower jaw member 86 which is hinged to the upper jaw 84. The lower jaw 86 is biased in the open position by a tension spring 88 and is locked in a closed position by means of a spring-biased latch 90 on top of the gripper assembly 36 as best viewed in FIG. 7. During the transfer operation, the trailing edges of the fabric workpieces 10 and 12 which project beyond the edge of the loading table 42 enter the space between the open jaws 84 and 86 of the gripper assembly 36. A ramp-shaped cam surface 92 projecting from the assembly 45 engages the lower portion of the jaw 86 and raises it until it is locked closed by the lock 90. A tooth 94 in the lower jaw impales the workpieces 10 and 12 and is received in a recess 96 in the upper jaw 84, thereby positively engaging the workpieces 10 and 12 with the gripper assembly 36.

On the completion of the closing of the jaws 86 and 84, a pneumatic actuator 98 mounted on the movable trailing edge gripper assembly 36 extends to release a trigger (not shown) on the gripper assembly 45 to cause the gripper 72 to release the trailing edges.

Figures 12, 13, 14:
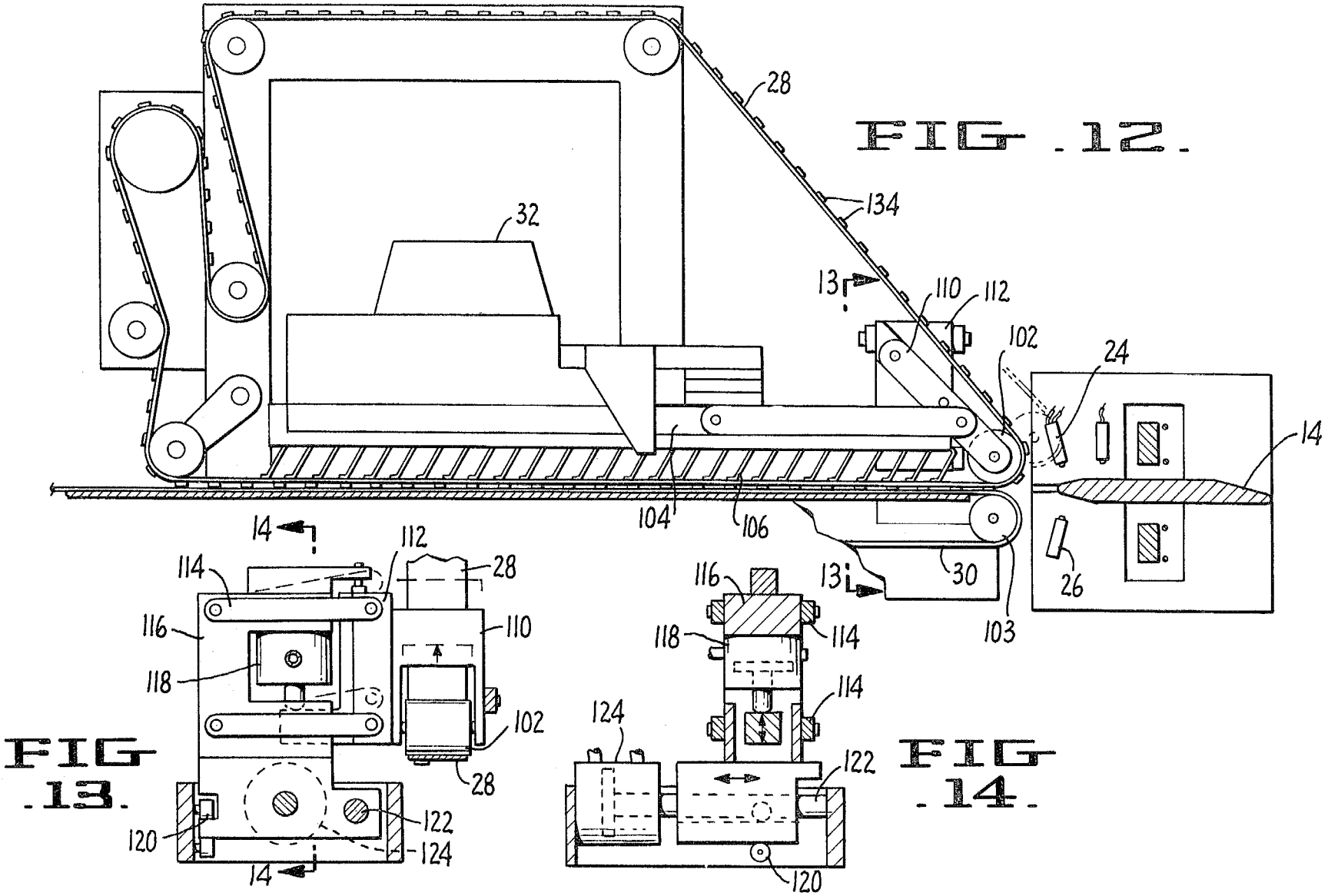
FIG. 12 is an enlarged, vertical, sectional view of the guide wheel assembly, serving station and belt takeaway assembly according to the invention.
FIG. 13 is an enlarged, vertical, sectional view, with portions broken away, taken generally along the lines 13—13 of FIG. 12.
FIG. 14 is an enlarged, vertical, sectional view, with portions broken away, taken generally along the lines 14—14 of FIG. 13.

At approximately the same time the trailing edges of the workpieces are being transferred, the needles 44 are withdrawn back into the sleeve 76 to thereby free the leading edges of the fabric workpieces 10 and 12 to be gripped between the moving belts 28 and 30. Referring now more particularly to FIGS. 12, 13 and 14, the mechanism by which the belt 28 is moved to grip the leading edges of the fabric workpieces 10 and 12 upon loading will be described.

The belts 28 and 30, as previously mentioned, draw the leading edges of the fabric workpieces past the sewing machine 32. The upper belt 28 travels on a convoluted pulley system 100 which returns the belt 28 from downstream of the sewing machine 32, up and over the machine and back to the area of the separating bar 14 and the guide wheels 16 and 18. At its closest point to the separating bar 14, the belt 28 passes around a forward pulley 102 and then travels beneath a ski-shaped backing member 104 which has a plurality of projecting leaf springs 106 to maintain the belt 28 flat against the belt 30 and a sub-supporting surface 108. The belt 30 passes around a corresponding pulley 103 at approximately the same location.

The pulley 102 is rotatably mounted at the lower end of a diagonally positioned bar 110 whose upper end is bolted to a movable block 112. As best shown in FIG. 13, the block 112 is attached by swing arms 114 to a support block 116. A pneumatic actuator 118 is connected to raise the movable block 112 as indicated in dashed-line fashion in FIG. 13.

The support block 116 and the other elements mounted on it are positioned adjacent the guide wheel assembly and downstream from it. The support block 116 is also mounted on rollers 120 and a horizontal shaft 122 to slide in a direction parallel to the direction of travel of the belt 28. Although not shown in the figures, the pulley 103 is connected to the block 116 to move with it. A pneumatic actuator 124 is positioned to move the block along this direction as best shown in FIG. 14.

In operation, when the loading table 42 is moved to the release position, adjacent the guide wheels 16 and 18, the sensor 68 triggers the actuator 118 to raise the block 112 and hence the pulley 102 and the belt 28, and simultaneously triggers the actuator 124 to move the block 116 and the pulleys 102 and 103 toward the separating bar 14, as shown in dashed-line fashion in FIG. 12. This sequence of steps allows the leading edges of the workpieces 10 and 12 to be received between the belts 28 and 30 and thereby be captured. The cylinders 116 and 118 thereafter retract to their original positions as shown in FIG. 12.

Figures 3, 4:
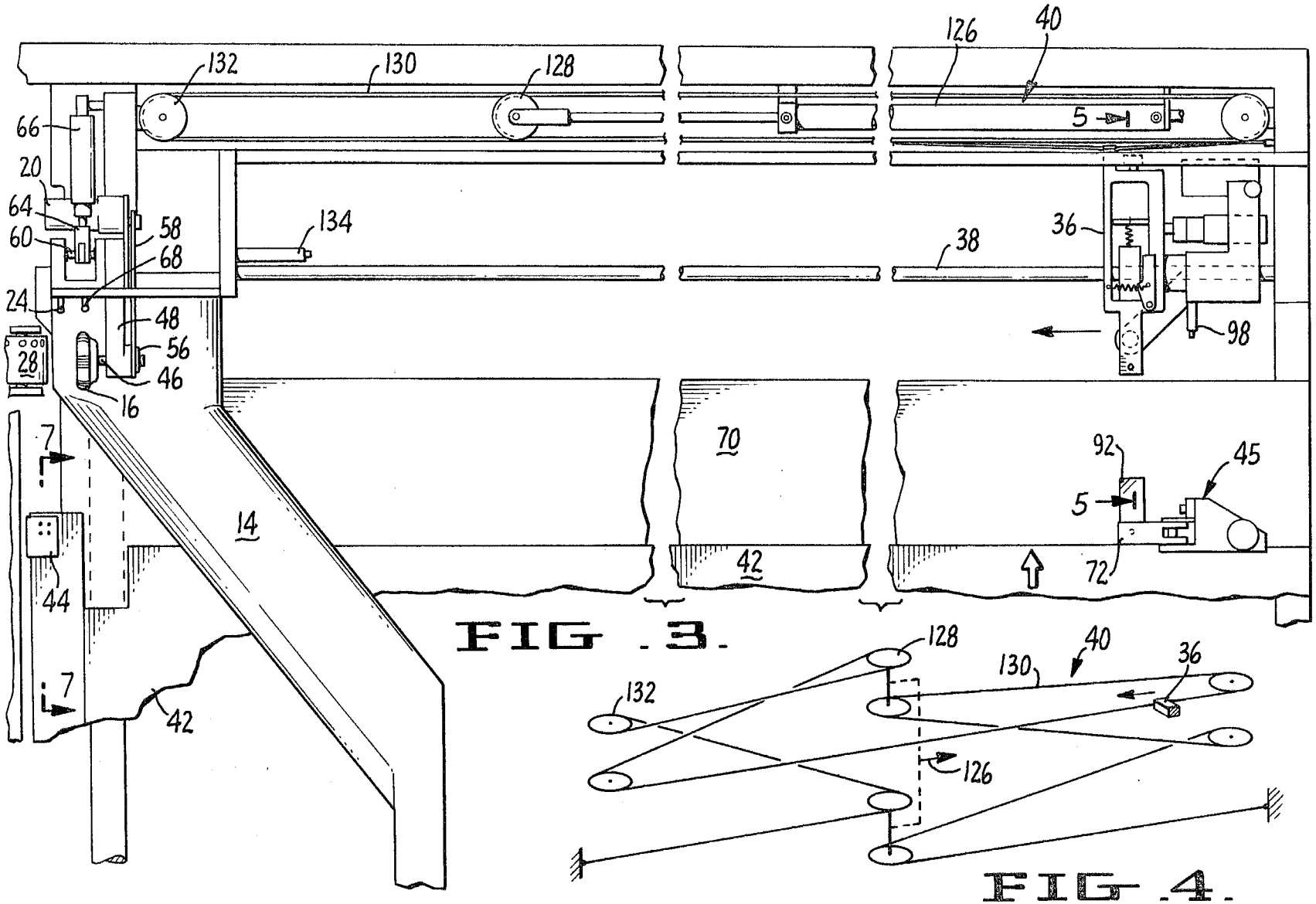
FIG. 3 is a plan view, with portions broken away and partly in section of the seamer depicted in FIG. 1.
FIG. 4 is a diagrammatic view of the trailing end gripper tension assembly according to the invention.

With the engagement of the leading edges of the workpieces 10 and 12 between the belts 28 and 30, the workpieces are drawn past the sewing machine 32 and through the guide wheels 16 and 18 which have now been lowered to engage the workpieces independently of each other. In order to provide a constant tension on both workpieces so that one workpiece will not creep ahead of the other and cause puckering, the trailing edge gripper assembly 36 is slidable on the bar 38 with a constant restraining force applied by the pulley and actuator assembly 40. The assembly 40 comprises a pneumatic actuator 126 which is anchored at one end and has a pulley 128 attached to its piston rod end. The pulley 128 has a cable 130 entrained about it and a series of fixed and movable pulleys 132 as best shown in FIGS. 1 and 4. The trailing edge gripper 36 is attached to one span of the cable 132 between the sets of pulleys so that the force of the actuator 126 is approximately divided in half in its application to the trailing edge gripper 36. The actuator is pressurized so as to maintain a constant restraining force on the gripper 36.

When the trailing edge gripper 36 arrives at the position adjacent the guide wheels 16 and 18, a pneumatic actuator 134 is energized as best viewed in FIG. 6, to release the spring biased latch 90 and thereby cause the lower jaw 86 of the trailing edge gripper to drop free and to release the trailing edges of the workpieces 10 and 12.

Referring again to FIG. 12, the upper clamping belt 28 is provided with a series of longitudinally spaced apart, raised, resilient buttons 134 which project from the face of the belt 28 which mates with the belt 30. These buttons 134 are located immediately adjacent the edge of the belt which is closest to the sewing machine 32 and are spaced $\frac{3}{4}''$ (2 cm.) apart. They are $\frac{1}{4}''$ (0.64 cm.) in diameter and approximately $\frac{1}{8}''$ (0.3175 cm.) to 3/10" (0.76 cm.) high. When the two layers (or panels) 10 and 12 are aligned with each other and are clamped between the belts 28 and 30 the buttons 134 bear against the pieces 10 and 12 and press them against the lower belt 30. This allows room for the pleats in the fabric pieces between the buttons 134 which are inherently generated when the non-straight edges of one or both of the pieces 10 and 12 are forced into a straight line by the guide wheels 16 and 18.

Near the end of the sewing operation for each pair of pieces 10 and 12; several inches before sewing together the trailing ends, the sewing machine 32 is programmed to speed up while the belts 28 and 30 are maintained at their original speeds. Slack in the portion of the sewn garment and its trailing stitch chain between the needle and the removal mechanism (not shown) is thereby generated which allows the stitch chain to be cut by a conventional thread cutter (not shown).

The controls for the actuators have not been described in detail, it being understood that they are conventional. The actuators 66, 80, 96, 118 and 124 are initially triggered by the sensor 68 upon loading.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

What is claimed is:

1. Improved apparatus for independently guiding two overlaid workpieces as they are simultaneously fed through a sewing work station of the type having a pair of opposed guide wheels located upstream from the work station with respect to the direction of workpiece feed through the work station; separate motor means for rotating the guide wheels in planes perpendicular to the direction of workpiece feed; means for separating the two workpieces and for individually supporting a portion of each workpiece against a different guide wheel; and sensor means for monitoring a detectable outline on at least one workpiece and for controlling the respective guide wheel motor means to rotate their guide wheels and center the workpiece outline opposite the sensor means and thereby manipulate and guide each workpiece; wherein the improvement comprises a gripper for gripping together the trailing ends of both workpieces; means for mounting the gripper so that it is slidable in the direction of workpiece feed; means for applying a constant retarding force on the gripper in a direction opposite to the direction of workpiece feed whereby tension is applied to the workpieces as they are guided and manipulated, and workpiece transport means positioned between the work station and the guide wheels for simultaneously clasping together the workpieces as they leave the guide wheels and drawing them past the work station; and loading means for initially gripping together the leading edges of the workpieces and initially gripping together the trailing edges of the workpieces and for thereafter automatically inserting the gripped-together leading edges into the workpiece transport means and the gripped-together trailing edges into the trailing end gripper.

2. Improved guiding apparatus as recited in claim 1, wherein the leading means include a movable carriage for inserting the workpieces' leading edges into the transport means from a direction which is non-parallel to the direction of workpiece feed through the workstation, whereby one pair of workpieces can be loaded onto the carriage while a previous pair of workpieces is drawn past the workstation.

3. Improved apparatus for independently guiding two overlaid workpieces as they are simultaneously fed through a sewing work station of the type having a pair of opposed guide wheels located upstream from the work station with respect to the direction of workpiece feed through the work station; separate motor means for rotating the guide wheels in planes perpendicular to the direction of workpiece feed; means for separating the two workpieces and for individually supporting a portion of each workpiece against a different guide wheel; and sensor means for monitoring a detectable outline on at least one workpiece and for controlling the respective guide wheel motor means to rotate their guide wheels and center the workpiece outline opposite the sensor means and thereby manipulate and guide each workpiece; wherein the improvement comprises a gripper for gripping together the trailing ends of both workpieces; means for mounting the gripper so that it is slidable in the direction of workpiece feed; means for applying a constant retarding force on the gripper in a direction opposite to the direction of workpiece feed whereby tension is applied to the workpieces as they are guided and manipulated, and workpiece transport means positioned between the work station and the guide wheels for simultaneously clasping together the workpieces as they leave the work station, the transport means including a pair of opposed, motor driven belts resiliently pressed into face to face engagement with each other along a portion of their lengths to clasp the workpieces together and wherein one of the belts is provided with a spaced apart series of projecting buttons to accommodate pleating of the workpieces between the buttons.

4. Improved apparatus for independently guiding two overlaid workpieces as they are simultaneously fed through a sewing work station of the type having a pair of opposed guide wheels located upstream from the work station with respect to the direction of workpiece feed through the work station; separate motor means for rotating the guide wheels in planes perpendicular to the direction of workpiece feed; means for separating the two workpieces and for individually supporting a portion of each workpiece against a different guide wheel; and sensor means for monitoring a detectable outline on at least one workpiece and for controlling the respective guide wheel motor means to rotate their guide wheels and center the workpiece outline opposite the sensor means and thereby manipulate and guide each workpiece; wherein the improvement comprises a gripper for gripping together the trailing ends of both workpieces; means for mounting the gripper so that it is slidable in the direction of workpiece feed; means for applying a constant retarding force on the gripper in a direction opposite to the direction of workpiece feed whereby tension is applied to the workpieces as they are guided and manipulated, and workpiece transport means for conveying the workpieces from the guide wheels through and past the work station while clasping the workpieces together, the transport means including a pair of opposed, motor driven belts resiliently pressed into face to face engagement with each other along a portion of their lengths to clasp the workpieces together, a pair of belt support pulleys, each belt passing about a separate one of the pulleys as it enters into face to face engagement with the other belt, and means for selectively extending the pulleys toward the guide wheels while increasing the spacing between the pulleys, to clasp the leading edges of the workpieces during loading.

5. Apparatus for seaming together two overlaid workpieces comprising a sewing machine, opposed, moving belt transport means for clasping the workpieces together and drawing them in one direction through the sewing machine as it seams them together, means for guiding the edges of the workpieces into a predetermined alignment immediately prior to the clasping of them by the belt transport means, means for grasping the trailing edges of the workpieces and for maintaining the workpieces in tension while the workpieces are drawn by the belt transport means, and a loader carriage for inserting the leading edges of the workpieces into position for engagement with the belt transport means, the loader carriage being movable from an initial position for receiving the workpieces for seaming and a loading position at which the leading edges of the workpieces are clasped by the belt transport means and further wherein the loader carriage, in moving from one position to the other, travels in a direction which is perpendicular to the direction of travel of the workpieces as they are drawn through the sewing machine.

6. Apparatus for seaming together two overlaid workpieces comprising a sewing machine, means acting traversely to the intended seam for guiding the edges of the workpieces independently of each other into a predetermined alignment, opposed, moving belt transport means for clasping the workpieces together as they leave the edge guiding means and drawing them in one direction through the sewing machine as it seams them together, means for grasping the trailing edges of the workpieces and for maintaining the workpieces in tension while the workpieces are drawn by the belt transport means, and a loader carriage for inserting the leading edges of the workpieces into position for engagement with the belt transport means.

7. Improved guiding apparatus as recited in claim 6, wherein the improvement further comprises means for inducing slack in the workpieces as they exit from the sewing machine to allow successive, sewn together workpieces to be severed from each other.

* * * * *